US006651908B1

(12) United States Patent
Borglum et al.

(10) Patent No.: US 6,651,908 B1
(45) Date of Patent: Nov. 25, 2003

(54) FOAM MARKING DEVICE FOR YARDS

(75) Inventors: Richard P. Borglum, Nashua, IA (US); Anthony R. Borglum, Waterloo, IA (US); Kevin M. Kraus, Cedar Falls, IA (US)

(73) Assignee: Richway Industries, Ltd., Janesville, IA (US)

( * ) Notice: Subject to any disclaimer, the term of this patent is extended or adjusted under 35 U.S.C. 154(b) by 327 days.

(21) Appl. No.: 09/904,351

(22) Filed: Jul. 12, 2001

(51) Int. Cl.[7] ..... B05B 7/30

(52) U.S. Cl. ..... 239/343; 239/311; 239/142; 239/143; 239/337; 239/348; 239/DIG. 23; 222/190

(58) Field of Search ..... 239/142, 143, 239/302, 304, 308, 310, 311, 337, 338, 339, 343, 346, 348, 369, 370, 398, 754, DIG. 23; 222/190

(56) References Cited

U.S. PATENT DOCUMENTS

| | | | | |
|---|---|---|---|---|
| 625,621 | A | * 5/1899 | Whittier | 239/143 |
| 1,995,215 | A | * 3/1935 | Mehlsen et al. | 239/343 |
| 2,680,010 | A | 6/1954 | Dubay | |
| 4,296,875 | A | 10/1981 | Borglum | |
| 4,531,660 | A | 7/1985 | Ford, Jr. | |
| 4,901,925 | A | 2/1990 | Blake, III | |
| RE33,564 | E | 4/1991 | Ford, Jr. | |
| 5,238,155 | A | 8/1993 | Blake, III | |
| D351,215 | S | 10/1994 | Camara | |
| 5,411,177 | A | 5/1995 | Blake, III | |
| 5,725,129 | A | 3/1998 | Chapin et al. | |
| 6,308,866 | B1 | * 10/2001 | Hoang et al. | 222/190 |

* cited by examiner

*Primary Examiner*—Robin O. Evans
(74) *Attorney, Agent, or Firm*—McKee, Voorhees & Sease, P.L.C.

(57) ABSTRACT

The foam marking device of the present invention includes a solution tank with a tube extending upwardly therein. An air line extends from an air pump and into the tank so as to provide air into the tube. The air passes through a porous element so as to create air bubbles. The tube includes an elongated slot that allows foam solution within the tank to enter the tube. The air bubbles generate foam within the upper end of the tube. The foam passes through a homogenizer at the upper end of the tube and then into a foam line for discharge onto the ground. The slot serves dual functions, by allowing solution in the tank to enter the tube and by allowing foam within the tube to enter the tank when the pressure in the foam discharge line exceeds the pressure within the tube.

15 Claims, 2 Drawing Sheets

FOAM MARKING DEVICE FOR YARDS

BACKGROUND OF THE INVENTION

Devices for generating and dispensing foam used for marking rows in agricultural fields are well known in the farming industry. Such agricultural foam marking systems include relatively large tanks of water to be mixed with foam solution to accommodate the large fields in which the foam is used. Such devices are typically mounted on tool bars or sprayers, both of which may have elongated boom arms extending laterally from the line of travel of the tractor. Since the end of the boom arms are a significant distance from the tractor driver, foam is dispensed at the end of the boom arm to provide a visual site that the driver can track along when the tractor is turned around for return along the next adjacent row in the field.

There is a need for a similar, yet smaller and simpler foam marking device for use in yards and acreages. Such a foam marking device can be used during spraying, seeding, or mowing. Such a device can provide foam markers on one edge of each row of a spreader, sprayer, or mower so the operator can have a line of sight to travel along for each row.

Therefore, a primary objective of the present invention is the provision of a foam marking device for use in yards and acreages.

Another objective of the present invention is the provision of a foam marking device adapted to be used on a lawn and garden tractor, spreader or sprayer.

A further objective of the present invention is the provision of a foam marking device which is small in scale and simple in construction.

Another objective of the present invention is the provision of a yard foam marking device having a tank for containing the marking solution and having a tube within the tank in which the foam is generated.

Still another objective of the present invention is the provision of a method of providing foam for marking a yard or acreage during mowing, spraying, fertilizing, or seeding.

Another objective of the present invention is the provision of a yard foam marking device which is economical to manufacture, and safe and durable in use.

These and other objectives will become apparent from the following description of the invention.

BRIEF SUMMARY OF THE INVENTION

The foam marking device of the present invention includes a first tank for containing the foam solution, and a tube or second tank mounted within the first tank. The first tank has a cap at the upper end which is removably connected to the top of the tank. The tube includes an elongated slot extending along the tube substantially between the upper and lower ends thereof. The'slot allows solution to enter the tube so that the solution is at the same level as within the first tank. An air stream is passed through a porous element at the bottom of the tube so as to generate small bubbles, which pass upwardly through the fluid solution within the tube and generate foam bubbles within the tube above the solution level. The foam passes into a foam line connected to the cap of the first tank and is discharged on the ground to mark the travel rows. A second porous element or homogenizer is provided at the upper end of the tube so as to standardize the size of the foam bubbles passing out of the tube and into the foam line.

DETAILED DESCRIPTION OF THE INVENTION

Figure 1:
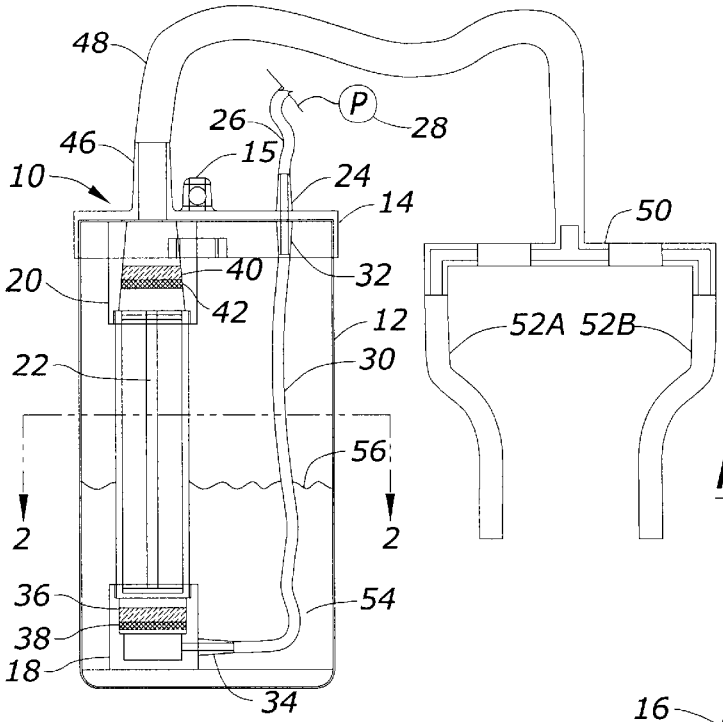
FIG. 1 is a side elevation view of the foam marking device of the present invention.
Figure 2:
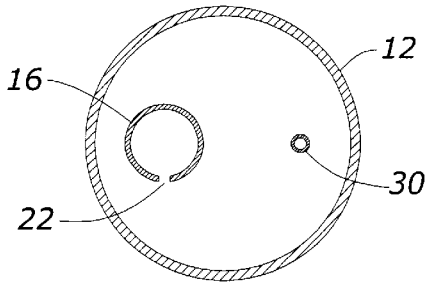
FIG. 2 is a sectional view taken along lines 2—2 of FIG. 1.
Figure 4:
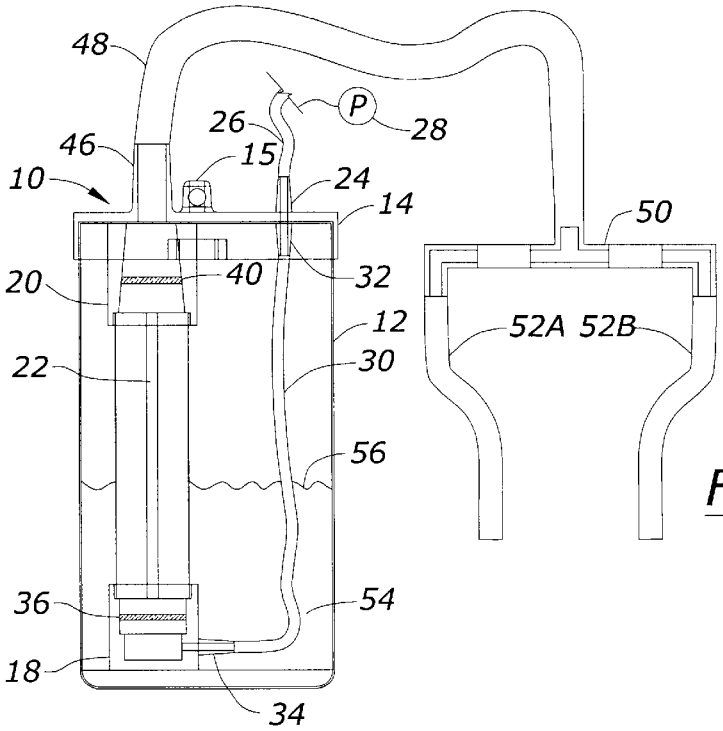
FIG. 4 is a view similar to FIG. 1 showing an alternative embodiment of the yard marking device of the present invention.
Figure 3:
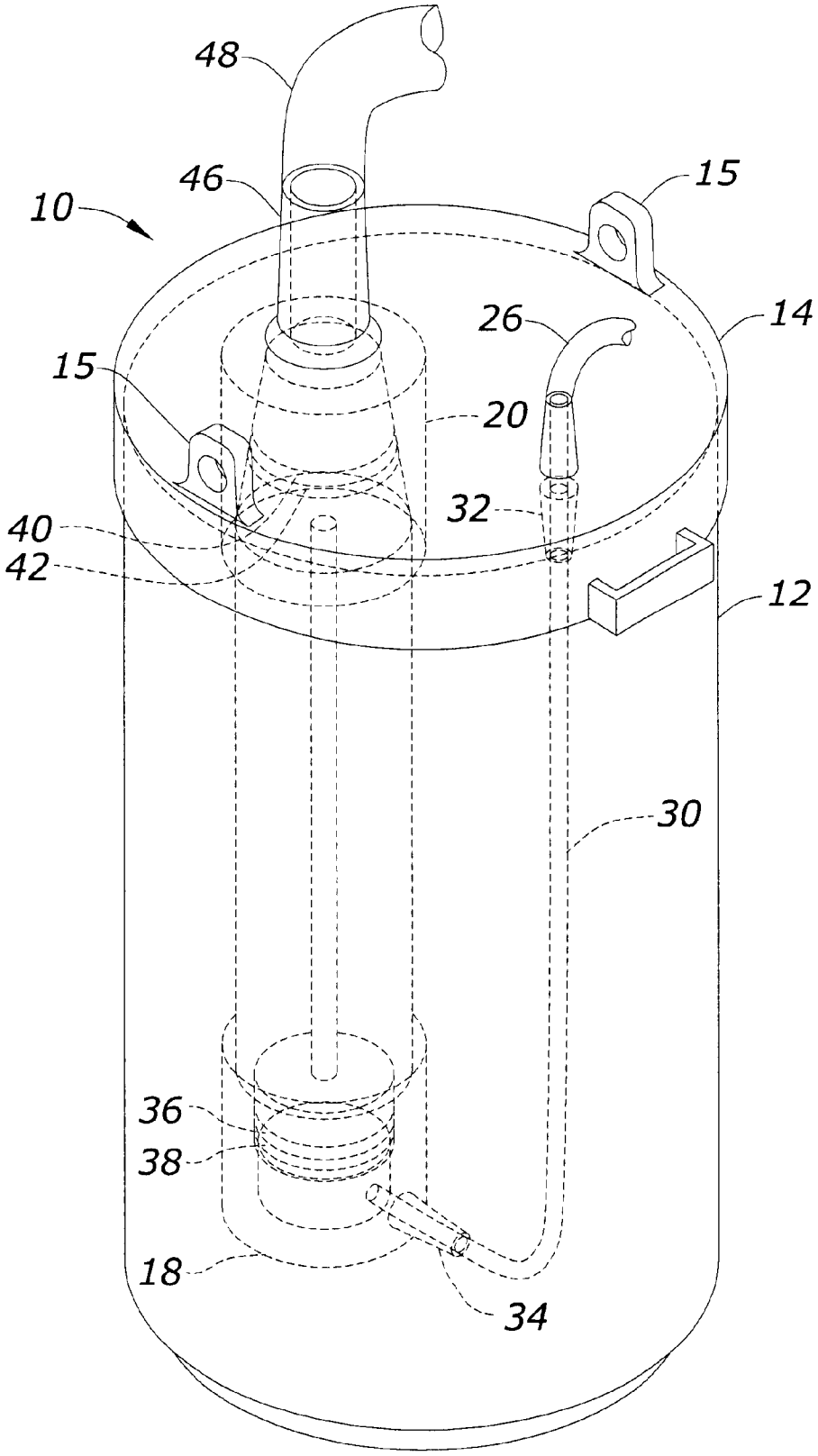
FIG. 3 is a perspective view of the device.

The foam marking device of the present invention is generally designated by the reference numeral 10 in the drawings. The device 10 includes a first or primary tank 12 for containing the foaming solution. The tank 12 includes a cap 14, which preferably is removable in any convenient manner, such as threads or a snap fit. A tube 16 is mounted within the tank 12 in an upright orientation. In a preferred embodiment, a plug or base 18 is provided in the bottom of the tank 12, with the lower end of the tube 16 being received within the plug 18 to maintain the tube 16 in upright position. The upper end of the tube 16 is received within a plug 20 extending downwardly from the inside of the cap 14. Thus, the tube 16 functions as a tank within the solution tank 12. The device 10 may be mounted on a lawn or garden tractor, sprayer, or spreader in any convenient manner, such as by tabs 15 on the cap 14.

The tube 16 includes an elongated slot 22 extending substantially between the upper and lower ends of the tube 16. The slot 22 is approximately one-quarter inch wide. Preferably, the slot 22 is continuous, though it is understood that the slot may include separate upper and lower portions so as to be discontinuous.

The cap 14 includes an air inlet coupler 24 to which an air line 26 is connected. The opposite end of the air line 26 is connected to an air pump 28, which preferably is battery powered.

An air line 30 resides within the tank 12, and extends between an internal air coupling 32 on the inside of the cap 14 and an air coupling 34 on the lower plug 18.

Mounted within the plug 18 or within the lower end of the tube 16, is a porous element 36. The porous element 36 may be mounted in any convenient fashion. As shown in the drawings, the element 36 is supported by a screen 38, though other support means may be provided. A second porous element 40, or homogenizer, is provided in the top of the tube 16 or in the upper plug 20. The upper porous element 40 may be supported in any convenient means, such as by a screen 42, as shown in the drawings.

A foam outlet 46 is provided on the cap 14. A foam line 48 is connected to the foam outlet 46 and has an outer end connected in any convenient manner to one edge of the yard implement being used, such as the edge of a mower deck, spreader or sprayer. The homogenizer element 40 may be located in the foam line 48, as an alternative being within the tube 16 or plug 20, as described above. If desired, the foam line 48 may branch into two or more lines, such as shown in the drawings, wherein a tee element 50 splits the foam line 48 into two discharge lines 52A, 52B.

In use, a foaming solution 54 is supplied to the tank 12 by removing the cap 14. Alternatively, a fill opening may be provided on the cap 14 with a conventional closure member sealing the fill opening. The air pump 28 is then actuated to supply air through the air lines 26 and 30. The solution 54 in the tank 12 passes through the slot 22 in the tube 16 such that the level of solution 54 within the tube 16 is substantially equal to the level of the solution in the tank 12. The stream of air from the air line 30 passes through the porous element 36 and is broken into tiny bubbles, which rise through the solution 54 so as to form foam within the tube 16 as the bubbles break the surface 56 of the solution 54 within the tube 16. The generated foam fills the upper end of the tube 16 above the solution level, and passes through the upper porous element 40 which homogenizes the foam such that the foam bubbles have a substantially uniform size. The homogenized foam then passes out the foam line 48 for discharge onto the ground. If the pressure in the foam line 48 exceeds the pressure within the upper end of the tube 16, the foam within the tube 16 will pass outwardly through the slot 22 for collection in the tank 12. Thus, the slot 22 allows solution to enter the tube 16 and allows foam to exit the tube 16, thereby equalizing pressure within the tank 12 and the foam line 48.

Whereas the invention has been shown and described in connection with the preferred embodiment thereof, it will be understood that any modifications, substitutions, and additions may be made which are within the intended broad scope of the following claims. From the foregoing, it can be seen that the present invention accomplishes at least all of the stated objectives.

What is claimed is:

1. A foam marker device, comprising:

a first tank for holding a foamable solution;

a second tank within the first tank and having upper and lower ends;

an air inlet in the lower end of the second tank to supply a stream of air into the second tank;

a foam outlet in the upper end of the second tank;

a slot in the second tank to let solution from the first tank pass into the second tank so as to generate foam in the second tank when air is introduced into the second tank; and the slot extending above the solution in the first tank to allow foam to escape from the second tank into the first tank to relieve pressure in the second tank.

2. The device of claim 1 further comprising an air supply line having a first end adapted to be connected to an air pump and a second end connected to the air inlet on the second tank.

3. The device of claim 1 further comprising a foam line having a first end connected to the foam outlet of the second tank and a second end to discharge foam.

4. The device of claim 1 wherein the foam line includes a screen to form the foam into foam droplets.

5. The device of claim 1 wherein the first tank includes a removable cap.

6. The device of claim 1 wherein the second tube includes a porous element above the air inlet to break the stream of air into air bubbles.

7. A method of generating and dispensing foam, comprising:

supplying foam solution into a tank;

allowing the foam solution to enter a tube in the tank;

supply air to the tube so as to generate foam within the tube above the solution;

discharging the foam into a foam line operatively connected to the tube;

dispensing the foam from the foam line; and allowing foam to exit the tube into the tank when the pressure in the foam line exceeds the pressure in the tube.

8. The method of claim 7 further comprising passing the air through a porous element before entering the tube to create air bubbles.

9. The method of claim 7 further comprising passing the foam through a homogenizer before dispensing the foam from the line.

10. The method of claim 7 further comprising passing the foam through a homogenizer before discharging the foam into the foam line.

11. The method of claim 7 wherein the solution enters the tube through a slot in the tube and the foam exits the tube through the slot.

12. A device for making foam for dispensing on a yard, comprising:

a foam solution tank;

a tube mounted in the tank with a slot in the tube adapted to allow solution into the tube;

an air line for supplying air to the tube to form foam from the foam solution in the tube;

a foam line to deliver foam from the tube to the yard; and the slot extending above the solution in the tube to allow foam to exit the tube into the tank to balance the pressure in the tube and in the foam line.

13. The device of claim 12 wherein the tank includes a removable cap.

14. The device of claim 12 further comprising a porous element adjacent the tube through which the air passes to form air bubbles.

15. The device of claim 12 further comprising a porous element through which the foam passes to homogenize the foam.

* * * * *